United States Patent [19]

Hansen et al.

[11] 4,256,264

[45] Mar. 17, 1981

[54] TUBE MILL

[75] Inventors: Ib Hansen; Hans Gommesen, both of Copenhagen, Denmark

[73] Assignee: F. L. Smidth & Co., Cresskill, N.J.

[21] Appl. No.: 15,745

[22] Filed: Feb. 27, 1979 (Under 37 CFR 1.47)

[30] Foreign Application Priority Data

Feb. 27, 1978 [GB] United Kingdom ..... 7674/78

[51] Int. Cl.[3] ..... B02C 17/07

[52] U.S. Cl. ..... 241/72; 241/177

[58] Field of Search ..... 241/70–72, 241/76–78, 171, 181

[56] References Cited

U.S. PATENT DOCUMENTS

| | | | |
|---|---|---|---|
| 1,040,876 | 10/1912 | Buxton . | |
| 1,361,205 | 12/1920 | Van Zandt . | |
| 1,591,941 | 7/1926 | Newhouse | 241/72 X |
| 1,787,897 | 1/1931 | Durnin . | |
| 1,793,495 | 2/1931 | Lee et al. . | |
| 2,405,633 | 8/1946 | Barker et al. | 241/70 |
| 3,332,701 | 10/1943 | Dowsett . | |
| 3,599,882 | 8/1971 | Sabaski et al. | 241/70 |
| 3,633,832 | 1/1972 | Fagerholt | 241/70 |
| 3,718,286 | 2/1973 | Fagerholt | 241/70 X |
| 3,776,477 | 12/1973 | Hansen et al. | 241/72 |
| 3,801,025 | 4/1974 | Slegten | 241/70 |
| 3,964,717 | 6/1976 | Hansen | 241/71 |

*Primary Examiner*—Howard N. Goldberg
*Attorney, Agent, or Firm*—Pennie & Edmonds

[57] ABSTRACT

A material grinding tube mill having a composite diaphragm (5) at the outlet end of a grinding chamber (3). The diaphragm comprises a coarse grate (6) facing the grinding chamber (3) for retaining grinding bodies in the chamber (3), and, on the side of the grate (6) remote from the chamber, a sieving screen (7) for sieving the ground product. The coarse grate has a plurality of openings (20) which constitute substantially the effective open area of the coarse grate. Disposed within the space defined between the coarse grate (6) and the sieving screen (7) are guiding members (21, 22) to guide coarse particles backwards to the grinding chamber (3) through one or more apertures (19) in the coarse grate (6) which allows free passage of the coarse particles.

28 Claims, 7 Drawing Figures

TUBE MILL

This invention relates to grinding tube mills and more particularly to a rotatable tube having one or more grinding chambers either separated by a diaphragm or equipped with a diaphragm at the outlet.

BACKGROUND ART

Tube mills which are used for processing materials, such as cement raw meal or clinker in grinding chambers are well known.

In some known grinding tube mills, a composite diaphragm is positioned at the outlet end of a grinding chamber. The diaphragm includes a coarse grate which faces the grinding chamber for retaining grinding bodies in the chamber in combination with a sieving screen on the side of the grate downstream from the chamber for sieving the ground product. A mill of this construction is described in U.S. Pat. No. 3,776,477.

A primary purpose of a composite diaphragm is to retain grinding bodies in the grinding chamber thus preventing the grinding bodies from passing from one grinding chamber into the next or out of the mill. A secondary purpose is to protect the sieving screen against the wearing action of the grinding bodies. A third purpose of a composite diaphragm is to maintain a constant sieving area having well defined unclogged sieve openings substantially during the lifetime of the diaphragm to sieve the ground material. In this manner, ground material of specific particle sizes within a specific dimensional range is allowed to pass to the next grinding chamber or out of the mill. Thus the size of the grinding bodies in each grinding chamber may be correlated with the specific particle size range. It should be especially noted that small grinding bodies suitable for grinding a preground material are unable to grind even a small amount of oversized particles.

Many attempts have been made to construct a composite diaphragm fulfilling these purposes in an ideal manner. In the prior art several proposals for composite sieving devices are known comprising two members in close contact with each other wherein the first member faces the inlet of the mill and is a coarse rigid screen which allows all the ground material to pass but prevents grinding bodies from coming into contact with the second member. The second member is a sieving screen having openings small enough to separate off oversize grains. However, in this arrangement, the second member is usually of a slight construction because necessarily the number of openings have to be great in order to obtain sufficient effective area for allowing passage of material and air through the mill. Although the second member is spidery the wear on this member is tolerable because the grinding bodies are kept away from the second member by means of the coarse first member.

However, coarse particles including the oversize grains, worn down grinding bodies, and pieces of broken grinding bodies reach the sieving member through the coarse screen. Disadvantageously, this material and these pieces agglomerate together with fine material to clog the openings so that the total passage and thereby the transport capacity through the diaphragm is reduced. This tendency is increased by the fact that other hard, coarse particles or nibs, become wedged in the mouths of the openings. When the two members are separated, nibs, etc., are trapped and collect between them and may thereby cause an excessive wear of the sieving member or block the passage completely. Further, the coarse screen is usually built up of sections which are exposed to severe wear and have to be changed frequently because the slots in the screen weaken the construction. Further still, the slots are deformed by the hammering action of the grinding bodies. We have invented an improved composite diaphragm which avoids the above-noted limitations of the prior art diaphragms.

DISCLOSURE OF INVENTION

A tube mill for grinding material which comprises at least one grinding chamber having upstream and downstream end portions and a diaphragm at the downstream end portion of the grinding chamber. The diaphragm includes a grate which defines a plurality of openings for the passage of material, a screen positioned downstream of said grate so as to define a space therebetween, the screen defining a plurality of openings for the passage of material, and a plurality of guide members disposed within the space defined by the grate and the screen, to guide the material.

The tube mill may comprise a plurality of grinding chambers and a plurality of diaphragms which, in addition to the diaphragm positioned at the downstream end portion of the last grinding chamber, are positioned to separate successive grinding chambers.

In particular, the tube mill of the present invention provides for the grinding of material in at least one grinding chamber which has an upstream and a downstream end. The tube mill includes a diaphragm positioned within the donwstream end of the grinding chamber. The diaphragm has a relatively coarse grate facing the grinding chamber for retaining grinding bodies in the chamber and having a plurality of relatively coarse openings for the passage of relatively coarse material therethrough. The diaphragm also includes a sieving screen positioned downstream of the grate so as to define a space therebetween. The screen defines a plurality of openings dimensioned less than the openings defined by the grate for sieving the ground material passing through the grate. The diaphragm further includes a plurality of guide members disposed within the space defined by the grate and the screen to guide relatively coarse material not passing through the screen in a direction toward the material input end of the grinding chamber so as to pass through the grate to the grinding chamber for further grinding.

Preferably, the coarse grate is constructed of a plurality of isolated wear plates mounted at intervals to form the openings. When the coarse grate is built up by the use of adequate wear plates the effective area between the wear plates may be adjusted to a maximum width by choosing the dimension of the openings, so as to effectively hinder passage of the grinding bodies. The wear plates are of a sturdy construction so as not to be susceptible to appreciable wear in comparison with conventional grate plates, which are usually cast and are thus weakened by the slots or holes in the plate itself.

The present invention makes it possible for the coarse grate to protect the sieving screen against the wearing action of the grinding bodies and nibs. Only small pieces of the grinding bodies are allowed to pass through openings in the coarse grate. The sieving screen may, consequently, be provided with small openings by means of which an effective screening of the material is performed so that oversized material is detained in the narrow space between the coarse grate and the sieving screen from where it is guided backwards by guiding members through an aperture or apertures in the coarse grate of a size sufficient to allow unhindered return of the coarse material.

Meanwhile, the new construction of the present invention makes it possible to construct a diaphragm with an active surface independently of the width of the slots in the sieving screen and to maintain at least a direct ratio between the active surface and the cross section of the mill for various mill sizes.

The distance between the coarse grate and the sieving screen is preferably at least equal to the width of the coarse grate openings to prevent coarse particles barely passing through the openings from becoming jammed against the sieving screen.

According to a preferred embodiment the guiding members comprise short guide plates at the periphery of the mill which are inclined to direct nibs towards the center of the mill where a cone tapering towards the preceding grinding chamber further directs the nibs or coarse material through a central aperture in the coarse grate.

Coarse material and broken grinding bodies, which have passed through the openings in the coarse grate are, by means of these guide plates, lifted and guided in a cascading movement towards the center of the mill where they pass unhindered to the preceding grinding chamber. Thus, such particles are kept from accumulating in the narrow space between the coarse grate and the sieving screen. Removal of these particles avoids their obstructing the passage through the screen either by accumulation or by building up regular plugs in the slits or the openings in the sieving screen.

In one preferred embodiment a cone is centrally disposed of the screen and is provided with radial vanes which assist in directing coarse material toward the cone. These vanes catch the coarse particles so as to guide them directly towards the central cone, which directs them into the preceding grinding chamber.

In an alternative preferred embodiment the guiding members comprises plates inclined in relation to the axis of the mill which cooperate with a peripheral slit between the coarse grate and the internal surface of the mill.

In this embodiment the coarse particles are collected at the periphery and are guided out of the narrow space through the peripheral slit and into the grinding chamber.

Although a certain amount of coarse particles are present at all times in the narrow space between the coarse grate and the sieving screen, they do not have any opportunity to block the passage.

Preferably, the composite diaphragm is constructed so as to form a unit whereby the coarse grate and the sieving screen are mounted on a common frame. If the coarse grate is formed from wear plates they are mounted by means of oblong radially oriented spacers on distance pieces. Fixing bolts passing through the spacers fasten the wear plates to the frame. In this case the distance pieces assist in directing the coarse particles towards the central aperture in the coarse grate without lifting the fine material to any appreciable extent. This is so because the fine material passes directly through the sieving screen, more or less, while suspended in the ventilating air or gas through the mill. Thus, the spacers cooperate with the short plates at the periphery of the mill, the radial guiding vanes in the center of the mill and the central cone to separate off and direct the coarse particles backwards to the grinding chamber.

The central aperture, in an alternative preferred embodiment, may be in the form of an annular rimmed aperture which makes it possible to cover part of the central portion of the sieving screen to adjust the transport capacity of the diaphragm.

The present invention is also directed to a diaphragm for use in a tube mill having an upstream and a downstream end for grinding material. The diaphragm includes a relatively coarse grate facing the grinding chamber for retaining grinding bodies in the chamber. The grate defines a plurality of openings constituting substantially the effective open area of the grate and having a generally centrally positioned aperture. The grate further includes a plurality of wear plates positioned about the aperture so as to create the openings between adjacent wear plates. A sieving screen is positioned downstream of the grate so as to define a space therebetween. The space is at least approximately equal to the width of the grate openings. The screen defines a plurality of openings dimensioned less than the openings defined by the grate for sieving the ground material passing through said grate. A frame is positioned adjacent and downstream of the screen so as to secure the wear plates and the screen thereto. A plurality of oblong spacers are positioned generally radially in the space so as to separate the wear plates and the screen. A cone is positioned within the space generally centrally of the screen adjacent the aperture and tapering towards the grinding chamber. A plurality of vanes extending generally radially of the cone so as to guide coarse material in the space toward the cone. A plurality of guide members are positioned at the periphery of the mill and suitably dimensioned and oriented so as to direct coarse material not passing through the screen generally towards the cone and thereby to the grinding chamber for further grinding.

Alternately the cone may be an annularly rimmed member positioned within the space generally centrally of the screen adjacent the aperture and opening towards said grinding chamber.

BRIEF DESCRIPTION OF THE DRAWINGS

The present invention is described in detail below with reference to the drawings in which.

BEST MODE FOR CARRYING OUT THE INVENTION

Figure 1:
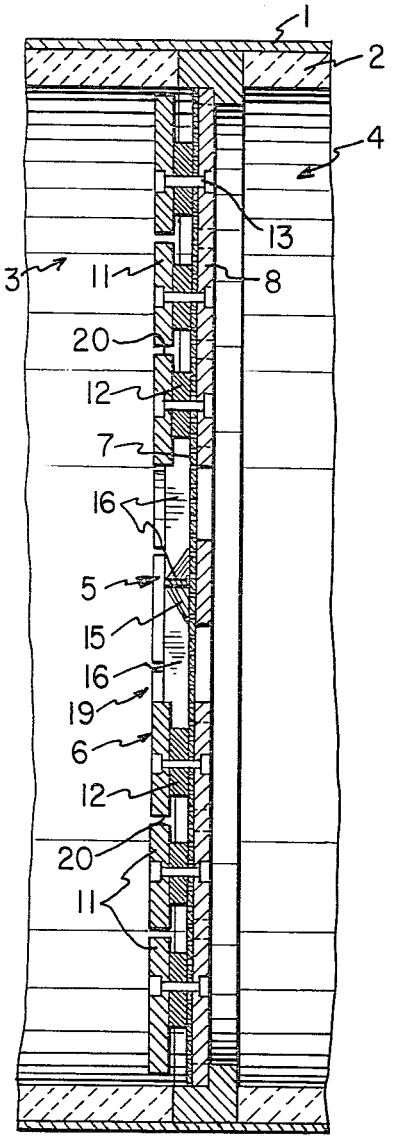
FIG. 1 is an elevational cross-sectional view of a first exemplary embodiment of the tube mill and composite diaphragm constructed according to the present invention.

Referring to FIGS. 1–6, a tube mill for grinding material is shown having a shell 1, an internal shell lining 2, a grinding chamber 3, and a discharge outlet 4. Alternately, discharge outlet 4 may be in the form of a second grinding chamber 4. The tube mill has a composite diaphragm 5 which includes coarse grate 6, sieving screen 7, and supporting frame 8, taken in the direction of flow of material. The coarse grate 6 is composed of wear plates 11 and spacers (or "distance pieces") 12. The spacers 12 may be constructed as part of the wear plates 11, or they may be in the form of separate components connected to the wear plates 11.

Figure 2:
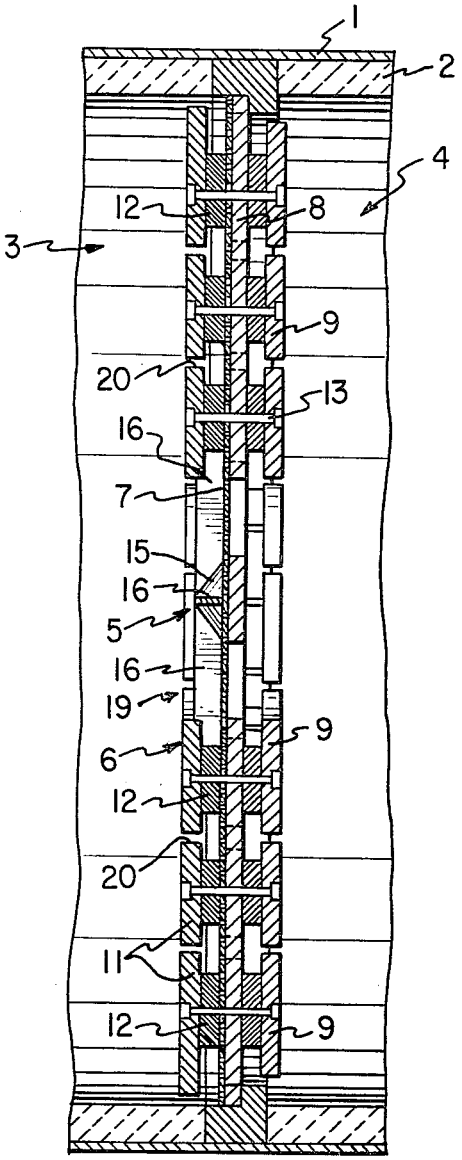
FIG. 2 is an elevational cross-sectional view of a second exemplary embodiment of the tube mill and composite diaphragm of the invention.

In the example illustrated in FIG. 2, the downstream side of the sieving screen 7 is protected by means of wear plates 9.

The central part of the sieving screen preferably has a cone 15 with guiding vanes 16 as shown in FIGS. 1–6. Alternately, as shown in the example in FIG. 7, a solid guiding rim 17 may be provided with vanes 18.

The coarse grate 6 constitutes a dam ring-like structure having a central aperture 19 and grate slots 20 established between the wear plates 11. The central aperture can, if desired, be formed with slits (not shown) to serve the same purpose.

The composite diaphragms illustrated in FIGS. 3, 4, 6 and 7 are of the type having a small compartment 23 bounded downstream by a solid dam ring 10, which supports the wear plates **9*a* and protects the downstream side of the composite diaphragm. Additional spacers 14 are inserted between the frame 8 and the solid dam ring 10**.

Figure 6:
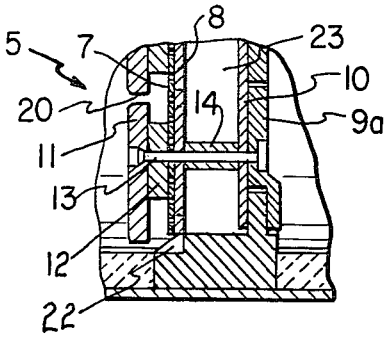
FIG. 6 is a fragmentary cross-sectional elevation of the tube mill and composite diaphragm of the present invention illustrating an alternate embodiment of the diaphragm.

The components of the composite diaphragm 5 are secured together by means of stay bolts 13 which pass through the composite diaphragm 5 as illustrated in FIG. 6. The stay bolts 13 fasten the wear plates 11 of the coarse grate 6 either with the frame 8 or with the wear plates 9 or **9*a***.

Figure 5:
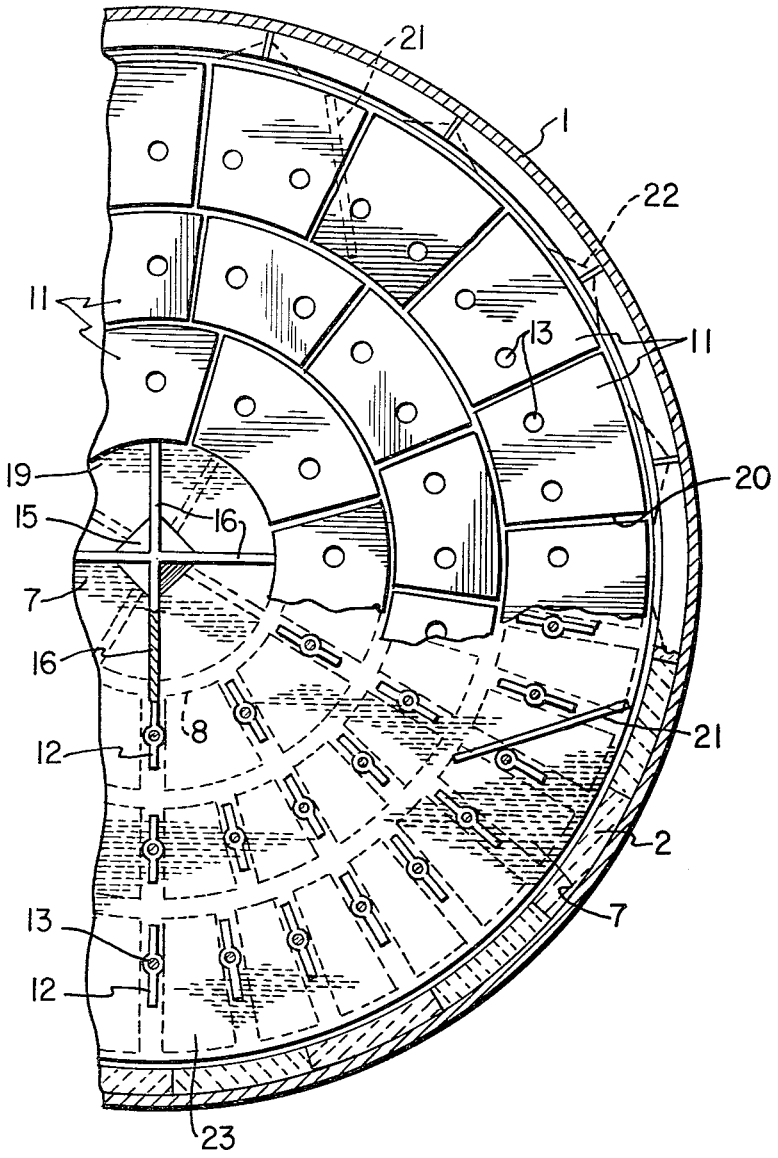
FIG. 5 is a front view, partially cut away, taken along lines 5—5 of FIG. 3.

Within the narrow space between the coarse grate 6 and the sieving screen 7 are short guiding plates 21 which are inclined at an offset angle from the radial direction of the composite diaphragm 5 as illustrated in FIG. 5. Alternately, the guiding members may also comprise guide plates 22 inclined to the axis of the mill as illustrated in FIG. 6.

Figure 3:
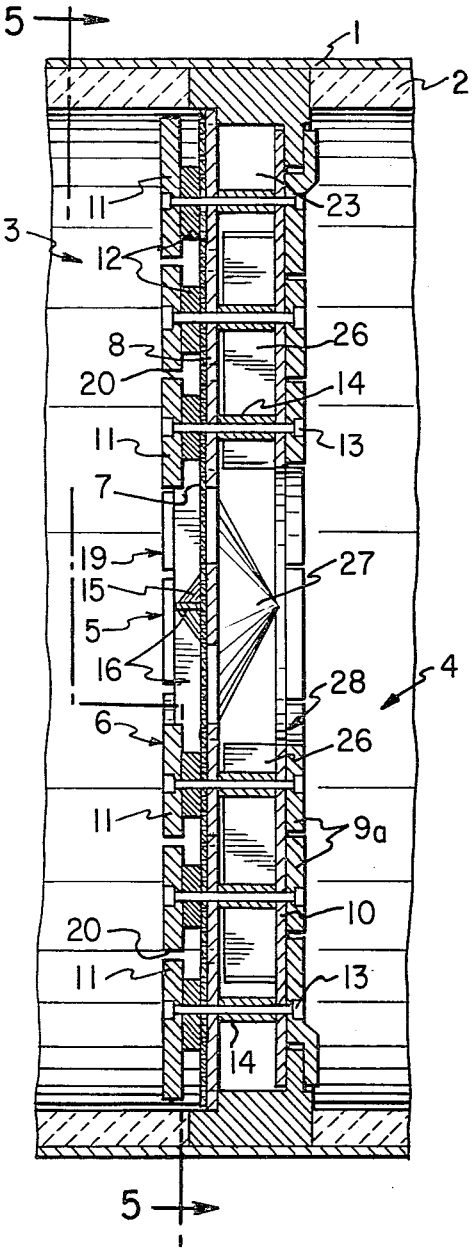
FIGS. 3 and 4 are elevational cross-sectional views of two additional alternative embodiments of the tube mill and composite diaphragm of the present invention.

In the exemplary embodiment illustrated in FIG. 3, a short compartment 23 has short lifters 26 between the frame 8 and the solid dam ring 10. A conical guiding device 27 guides the material lifted by the lifters 26 through a central aperture 28 in the solid dam ring 10. In the exemplary embodiment illustrated in FIG. 4, the compartment 22 is devoid of lifters 26 and is equipped at the central aperture 28 in the solid dam ring 10 with frustoconical collars 24 and 25.

Preferably, the distance between the coarse grate 6 and the sieving screen 7 is approximately 50 mm. The openings in the sieving screen 7 are from 2 to 2.5 mm and the width of the grate slots 20 between the wear plates 11 in the coarse grate are from 16 to 20 mm. However, the dimension of the openings between the wear plates 11 is not critical inasmuch as the grinding bodies are prevented from passing through the coarse grate 6 as a result of the sieving action of the sieving screen 7.

In a tube mill plant performing a primary grinding, the size of the openings in the sieving screen 7 may typically be 25 mm.

In operation, the coarse grate 6, by means of its wear plates 11, retains the grinding bodies in the grinding chamber 3 and thereby protects the delicate sieving screen 7 from the hammering and the wearing action of the grinding bodies. However, coarse material and possibly pieces of broken grinding bodies are permitted to pass through the grate slots 20 into the narrow space between the coarse grate 6 and the sieving screen 7. The sieving screen 7 effectively screens the fine ground material while the coarse material, the so-called nibs, and possibly pieces of broken grinding bodies, is directed by the guiding plates 21 towards the center of the composite diaphragm 5.

The movement of the coarse material is further guided by the spacers 12 and the guiding vanes 16 towards the central cone 15 which directs these particles back into the grinding chamber 3 through the central aperture 19.

Figure 7:
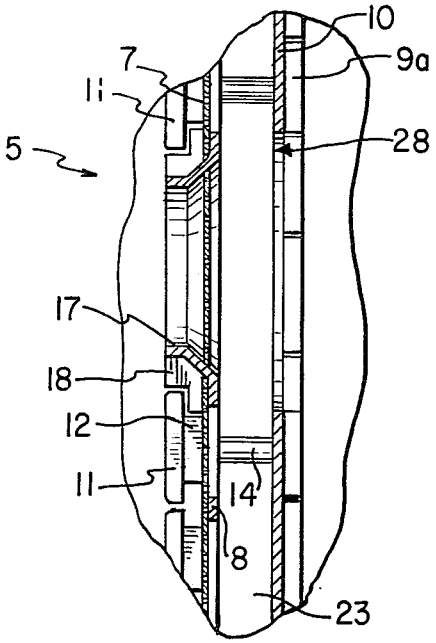
FIG. 7 is a fragmentary cross-sectional elevation of the composite diaphragm of the invention illustrating an alternate embodiment of the diaphragm.

In the alternative construction wherein the central aperture 19 is formed with slits (not shown) in the central area of the coarse grate 6, the coarse particles are guided by vanes 18 and a guiding rim 17 as illustrated in FIG. 7. Also, guide plates 22, which are inclined to the axis of the tube mill as illustrated in FIG. 6, can additionally provide for the return of the coarse material through the peripheral slit between the coarse grate 6 and the mill lining 2.

Upon passing the sieving screen 7 the fine ground material collects in the compartment 23 from which it either overflows into the discharge outlet 4 or is lifted by the short lifters 26 which permit a controlled amount of the fine ground material to be retained in the small compartment 23. The short lifters 26 can be adjustable.

Figure 4:
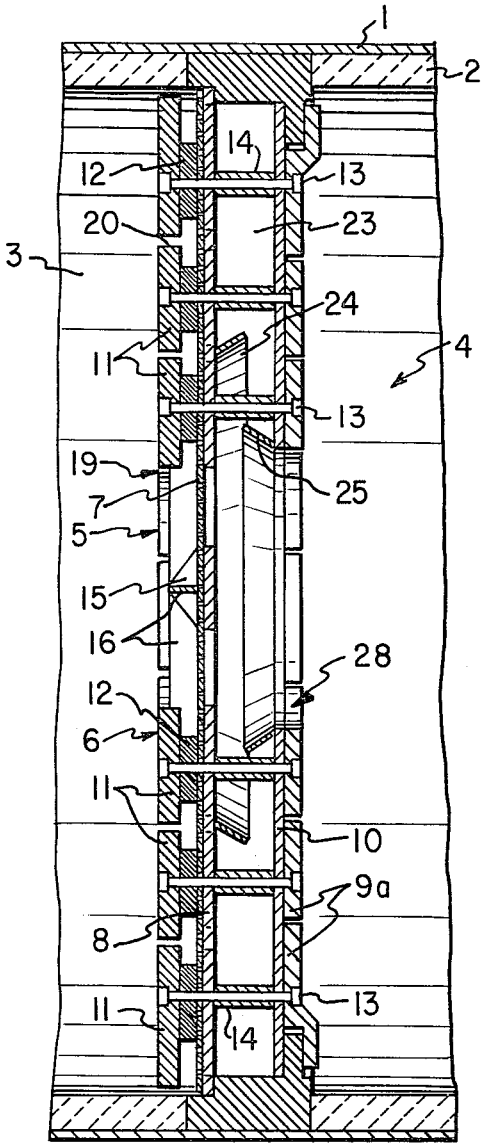

The frustoconical collars 24 and 25, illustrated in FIG. 4, control the passage of the fine ground material through the central aperture 28 of the solid dam ring 10. In the absence of such control the fine ground material may when lifted up, e.g., by the assistance of spacers 14, pass through central aperture 28 in an uncontrolled manner partly assisted by or blown by the ventilating air through the central opening 28 of the solid dam ring 10. The mass of fine ground material collected as a pool of material in the compartment 23, permits the control of grinding performance in the preceding grinding chamber 3 in a manner known in the art.

The composite diaphragm 5 is applicable in all types of tube mills and can be positioned either between a grinding chamber 3 and a discharge outlet 4 or between successive grinding chambers. The composite diaphragm 5 is also applicable in tube mills wherein the ground material can be discharged through central discharge openings in the tube shell 1, through peripheral openings in the outlet end of the tube mill, or through a hollow trunnion in connection with a central outlet.

We claim:

1. A tube mill for grinding material which comprises at least one grinding chamber having an upstream and a downstream end, a diaphragm positioned within the downstream end portion of said grinding chamber, said diaphragm having a relatively coarse grate facing said grinding chamber for retaining grinding bodies in said chamber, said grate having a plurality of relatively coarse openings for the passage of relatively coarse material therethrough, said openings constituting substantially the effective open area of said grate, said grate being formed by a plurality of wear plates dimensioned and positioned so as to create said openings between adjacent wear plates, a sieving screen positioned downstream of said grate so as to define a space therebetween, said screen defining a plurality of openings dimensioned less than the openings defined by said grate for sieving the ground material passing through said grate, a plurality of guide members disposed within the space defined by said grate and said screen to guide relatively coarse material not passing through said screen in a direction toward said upstream end so as to pass through said grate to said grinding chamber for further grinding.

2. The tube mill according to claim 1 wherein said space between said grate and said screen is at least approximately equal to the dimension of said grate openings.

3. The tube mill according to claim 2 wherein said space between said grate and said screen is at least approximately equal to the width of said grate openings.

4. The tube mill according to claim 1 further comprising a cone positioned within said space and generally centrally of said screen and tapering towards said grinding chamber.

5. The tube mill according to claim 4 wherein said guide members are in the form of vanes extending radially from said cone, so as to guide coarse material in said space towards said cone.

6. The tube mill according to claim 5 wherein said guide members are in the form of short plates positioned at the periphery of said grinding chamber.

7. The tube mill according to claim 1 further comprising an annular rimmed member positioned within said space centrally of said screen and opening towards said grinding chamber.

8. The tube mill according to claim 7 further comprising a plurality of vanes extending radially from said annular rimmed member so as to guide coarse material in said space outwardly towards the annular rim.

9. The tube mill according to claims 5 or 8 wherein said guide members comprise guide plates positioned at the periphery of the mill, and suitably dimensioned and oriented so as to direct coarse material generally towards the center of the mill and to said grinding chamber.

10. The tube mill according to claim 9 wherein said grate defines a peripheral opening with the mill lining and said guide plates cooperate with said peripheral opening and the inner surface of the mill to direct material toward said grinding chamber.

11. The tube mill according to claim 10 wherein said peripheral opening defined between said grate and the mill lining is in the form of a peripheral slit.

12. The tube mill according to claim 11 wherein said guiding members comprise end plates axially disposed adjacent to said peripheral slit and suitably dimensioned and oriented so as to direct coarse material through said peripheral slit into said grinding chamber.

13. The tube mill according to claim 12 wherein said grate comprises a plurality of wear plates positioned so as to create said openings between adjacent wear plates.

14. The tube mill according to claim 13 further comprising a frame positioned adjacent and downstream of said screen so as to secure said wear plates and said screen thereto.

15. The tube mill according to claim 14 further comprising a plurality of spacers radially positioned in said space between said wear plates and said frame so as to separate said wear plates and said screen.

16. The tube mill according to claim 15 wherein said spacers have an oblong configuration.

17. The tube mill according to claim 16 wherein said space between said grate and said screen is at least approximately equal to the dimension of said grate openings.

18. The tube mill according to claim 17 wherein said space between said grate and said screen is at least approximately equal to the width of said grate openings.

19. A tube mill for grinding material which comprises at least one grinding chamber having an upstream and a downstream end, a diaphragm positioned within the downstream end portion of said grinding chamber, said diaphragm having a relatively coarse grate facing said grinding chamber for retaining grinding bodies in said chamber, said grate defining a plurality of openings constituting substantially the effective open area of said grate and having a generally centrally positioned aperture, said grate comprising a plurality of wear plates positioned about said aperture so as to create said openings between adjacent wear plates, a sieving screen positioned downstream of said grate so as to define a space therebetween, said space being at least approximately equal to the width of said grate openings, said screen defining a plurality of openings dimensioned less than the openings defined by said grate for sieving the ground material passing through said grate, a frame positioned adjacent and downstream of said screen so as to secure said wear plates and said screen thereto, a plurality of oblong spacers generally radially positioned in said space so as to separate said wear plates and said screen, a cone positioned within said space generally centrally of said screen adjacent said aperture and tapering towards said grinding chamber, a plurality of vanes extending generally radially of said cone so as to guide coarse material in said space toward said cone, and a plurality of guide members positioned at the periphery of the mill and suitably dimensioned and oriented so as to direct coarse material not passing through said screen generally towards said cone and thereby to said grinding chamber for further grinding.

20. A tube mill for grinding material which comprises at least one grinding chamber having an upstream and a downstream end, a diaphragm positioned within the downstream end portion of said grinding chamber, said diaphragm having a relatively coarse grate facing said grinding chamber for retaining grinding bodies in said chamber, said grate defining a plurality of openings constituting substantially the effective open area of said grate and having a generally centrally positioned aperture, said grate comprising a plurality of wear plates positioned about said aperture so as to create said openings between adjacent wear plates, a sieving screen positioned downstream of said grate so as to define a space therebetween, said space being at least approximately equal to the width of said grate openings, said screen defining a plurality of openings dimensioned less than the openings defined by said grate for sieving the ground material passing through said grate, a frame positioned adjacent and downstream of said screen so as to secure said wear plates and said screen thereto, a plurality of oblong spacers generally radially positioned in said space so as to separate said wear plates and said screen, an annularly rimmed member positioned within said space generally centrally of said screen adjacent said aperture and opening towards said grinding chamber, a plurality of vanes extending generally radially of said annularly rimmed member so as to guide coarse material in said space outwardly towards the said annularly rimmed member, and a plurality of guide members positioned at the periphery of the mill and suitably dimensioned and oriented so as to direct coarse material not passing through said screen generally towards said annularly rimmed member and thereby to said grinding chamber for further grinding.

21. The tube mill of claims 19 or 20 wherein said guide members comprise guide plates offset from the radial of the diaphragm.

22. The tube mill of claim 21 wherein said grate defines a peripheral slit with the mill lining, said guide members further comprising end plates axially disposed adjacent to said peripheral slit and suitably dimensioned and oriented so as to direct coarse material through said peripheral slit into said grinding chamber.

23. A diaphragm for use in a tube mill having an upstream and a downstream end for grinding material, comprising a relatively coarse grate facing said grinding chamber for retaining grinding bodies in said chamber, said grate defining a plurality of openings constituting substantially the effective open area of said grate and having a generally centrally positioned aperture, said grate comprising a plurality of wear plates positioned about said aperture so as to create said openings between adjacent wear plates, a sieving screen positioned downstream of said grate so as to define a space therebetween, said space being at least approximately equal to the width of said grate openings, said screen defining a plurality of openings dimensioned less than the openings defined by said grate for sieving the ground material passing through said grate, a frame positioned adjacent and downstream of said screen so as to secure said wear plates and said screen thereto, a plurality of oblong spacers generally radially positioned in said space so as to separate said wear plates and said screen, a cone positioned within said space generally centrally of said screen adjacent said aperture and tapering towards said grinding chamber, a plurality of vanes extending generally radially of said cone so as to guide coarse material in said space toward said cone, and a plurality of guide members positioned at the periphery of the mill and suitably dimensioned and oriented so as to direct coarse material not passing through said screen generally towards said cone and thereby to said grinding chamber for further grinding.

24. A diaphragm for use in a tube mill having an upstream and a downstream end for grinding material comprising a relatively coarse grate facing said grinding chamber for retaining grinding bodies in said chamber, said grate defining a plurality of openings constituting substantially the effective open area of said grate and having a generally centrally positioned aperture, said grate comprising a plurality of wear plates positioned about said aperture so as to create said openings between adjacent wear plates, a sieving screen positioned downstream of said grate so as to define a space therebetween, said space being at least approximately equal to the width of said grate openings, said screen defining a plurality of openings dimensioned less than the openings defined by said grate for sieving the ground material passing through said grate, a frame positioned adjacent and downstream of said screen so as to secure said wear plates and said screen thereto, a plurality of oblong spacers generally radially positioned in said space so as to separate said wear plates and said screen, an annularly rimmed member positioned within said space generally centrally of said screen adjacent said aperture and opening towards said grinding chamber, a plurality of vanes extending generally radially of said annularly rimmed member so as to guide coarse material in said space outwardly towards the said annularly rimmed member, and a plurality of guide members positioned at the periphery of the mill and suitably dimensioned and oriented so as to direct coarse material not passing through said screen generally towards said annularly rimmed member and thereby to said grinding chamber for further grinding.

25. The diaphragm of claims 23 or 24 wherein said guide members comprise guide plates offset from the radial of the diaphragm.

26. The diaphragm of claim 25 wherein said grate defines a peripheral slit with the mill lining, said guide members further comprising end plates axially disposed adjacent to said peripheral slit and suitably dimensioned and oriented so as to direct coarse material through said peripheral slit into said grinding chamber.

27. A tube mill for grinding material which comprises at least one grinding chamber having an upstream and a downstream end, a diaphragm positioned within the downstream end portion of said grinding chamber, said diaphragm having a relatively coarse grate facing said grinding chamber for retaining grinding bodies in said chamber, said grate having a plurality of relatively coarse openings for the passage of relatively coarse material therethrough, said openings constituting substantially the effective open area of said grate, said grate being formed by a plurality of wear plates dimensioned and positioned so as to create said openings between adjacent wear plates, a sieving screen positioned downstream of said greate so as to define a space therebetween, said wear plates having a thickness greater than that of the sieving screen, said screen defining a plurality of openings dimensioned less than the openings defined by said grate for sieving the ground material passing through said grate, a plurality of guide members disposed within the space defined by said grate and said screen to guide relatively coarse material not passing through said screen in a direction toward said upstream end so as to pass through said grate to said grinding chamber for further grinding.

28. A tube mill for grinding material which comprises at least one grinding chamber having an upstream and a downstream end, a diaphragm positioned within the downstream end portion of said grinding chamber, said diaphragm having a relatively coarse grate facing said grinding chamber for retaining grinding bodies in said chamber, said grate having a plurality of relatively coarse openings for the passage of relatively coarse material therethrough, said openings constituting substantially the effective open area of said grate, a sieving screen positioned downstream of said grate so as to define a space therebetween, said screen defining a plurality of openings dimensioned less than the openings defined by said grate for sieving the ground material passing through said grate, said grate comprising a plurality of wear plates of thicker construction than the sieving screen so as to provide protection for said screen, said wear plates defining said relatively coarse openings, a plurality of guide members disposed within the space defined by said grate and said screen to guide relatively coarse material not passing through said screen in a direction toward said upstream end so as to pass through said grate to said grinding chamber for further grinding.

* * * * *